United States Patent [19]

Dietrich

[11] Patent Number: 4,774,485

[45] Date of Patent: Sep. 27, 1988

[54] POLARIZED MAGNETIC DRIVE FOR ELECTROMAGNETIC SWITCHING DEVICE

[75] Inventor: Bernhard Dietrich, Eichenau, Fed. Rep. of Germany

[73] Assignee: Klockner-Moeller Elektrizitats-GmbH, Bonn, Fed. Rep. of Germany

[21] Appl. No.: 103,046

[22] Filed: Sep. 30, 1987

[30] Foreign Application Priority Data

Oct. 17, 1986 [DE] Fed. Rep. of Germany ..... 3635431

[51] Int. Cl.[4] ..... H01F 7/08

[52] U.S. Cl. ..... 335/230; 335/78; 335/234

[58] Field of Search ..... 335/78, 79, 80, 81, 335/229, 230, 234

[56] References Cited

U.S. PATENT DOCUMENTS

| | | | |
|---|---|---|---|
| 3,070,730 | 12/1962 | Gray et al. | 335/229 |
| 3,859,547 | 1/1975 | Massie | 335/234 X |
| 4,490,701 | 12/1984 | Dietrich et al. | 335/78 |
| 4,533,890 | 8/1985 | Patel | 335/234 |

FOREIGN PATENT DOCUMENTS

| | | | |
|---|---|---|---|
| 1464993 | 10/1969 | Fed. Rep. of Germany | 335/229 |

*Primary Examiner*—George Harris

*Attorney, Agent, or Firm*—Foley & Lardner, Schwartz, Jeffery, Schwaab, Mack, Blumenthal & Evans

[57] ABSTRACT

The magnetic drive of an electromagnetic contactor comprises two spaced coils (10,11) having a coaxial bore in which an armature (14) is mounted for reciprocal movement between two end positions. A control slider (21) is disposed between the coils (10,11) with its two sides forming stops for the armature (14). When the armature (14) is changed over from one to the other end position, the slider is also changed over and limits, at the mid-position, the return movement of the armature (14) from the respective end position. In a contactor designed for tri-stable operation, undesired movement of the armature beyond the mid-position is avoided, which could otherwise lead to an inadvertent change-over of the armature (14) to the other end position. If the contactor is designed for monostable mid-position operation, oscillation of the armature (14) about the mid-position is prevented, so that this mid-position is stabilized.

14 Claims, 5 Drawing Sheets

POLARIZED MAGNETIC DRIVE FOR ELECTROMAGNETIC SWITCHING DEVICE

DESCRIPTIOND

This invention relates to a polarized magnetic drive for an electromagnetic switching device.

U.S. Pat. No. 4,490,701 discloses such a magnetic drive in which two separate coils act on an armature. Exciting both coils in the same sense in one or the other direction will move the armature to its one or other end position. In tristable operation, the armature can also be moved to a midposition by exciting the two coils in opposite senses. Upon de-energization, a permanent magnet holds the armature in its end or mid-position. When the armature returns from an end position, there is a risk that it swings beyond the mid-position and possibly reaches the opposite end position where it will then be held by the magnet. While this risk does not exist in an operation mode with a middle rest position, undesired oscillations of the armature about the mid-position may occur when the armature falls back from an end position.

It is an object of the present invention to avoid such disadvantages as occur in comparable magnetic drives of the prior art.

As a more specific object, the invention aims at providing a polarized magnetic drive in which the mid-position is specially stabilized irrespective of whether the drive is designed for tri-stable operation or for operation having only a stable mid-position.

To meet with these objects, the magnetic drive of this invention comprises two coils arranged along a common axis, a permanent magnet assembly which is substantially symmetrical to the center plane between the two coils, an armature actuated by the magnetic fluxes of the coils and the magnet assembly and being movable relative to the coils to a first end position upon excitation of the coils for producing a coil flux of one polarity, and to a second end position upon excitation of the coils for producing a coil flux of the opposite polarity, and a control slider also actuated by the magnetic fluxes of the coils and the magnet assembly and being movable, upon excitation of the coils, along the coil axis between the two coils, the slider forming stops for stopping the armature in a mid-position in either direction of armature movement.

When the relay is excited to move the armature to one of its two end positions, the control slider provided by the invention will be moved to such a position that it forms a stop for the armature when the latter returns to its mid-position, so that the armature is movable between said end position and the mid-position as in a normal two-position contactor. On changing-over the magnetic drive by exciting both coils in the opposite direction, the armature will move the control slider to its opposite position where it will now form a mid-position stop for the armature when the latter moves back from its opposite end position. The control slider thus prevents the armature, when it returns from an end position, from moving beyond the mid-position and even reaching the opposite end position.

Figure 1:
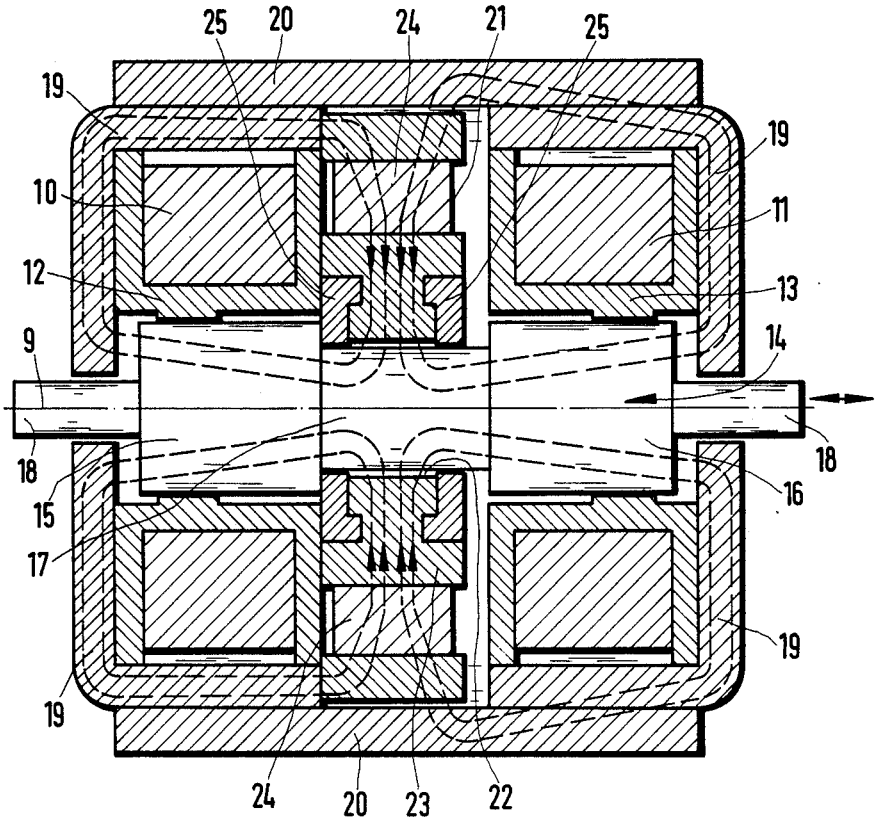
Figure 2:
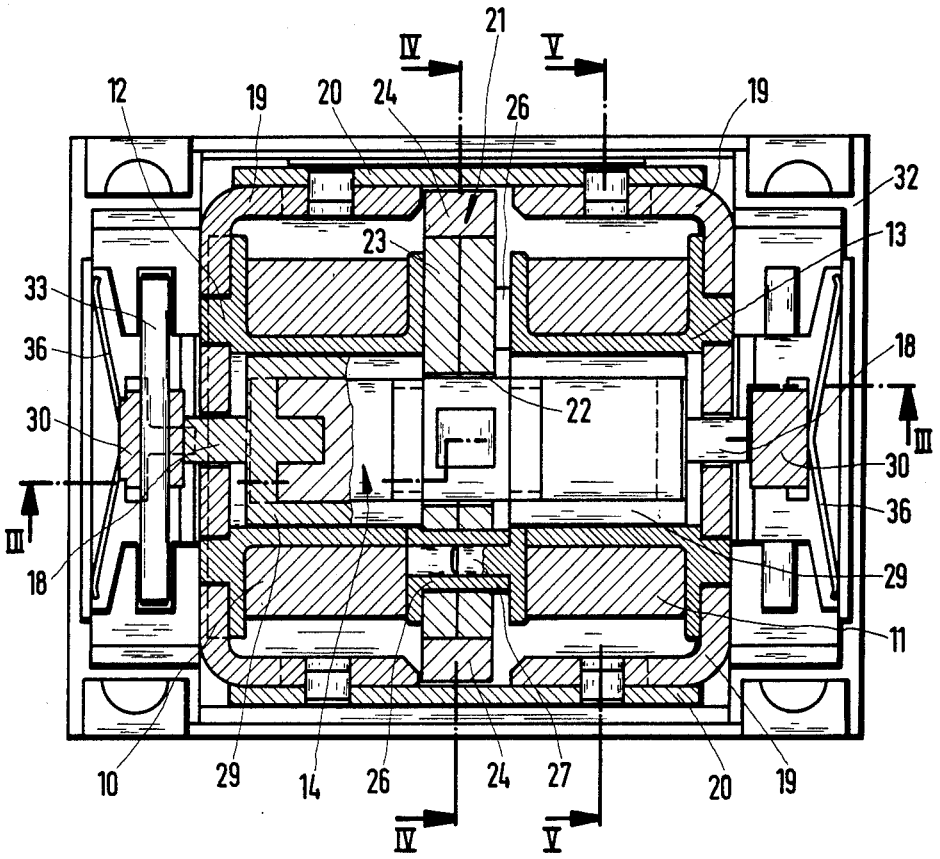
Figure 3:
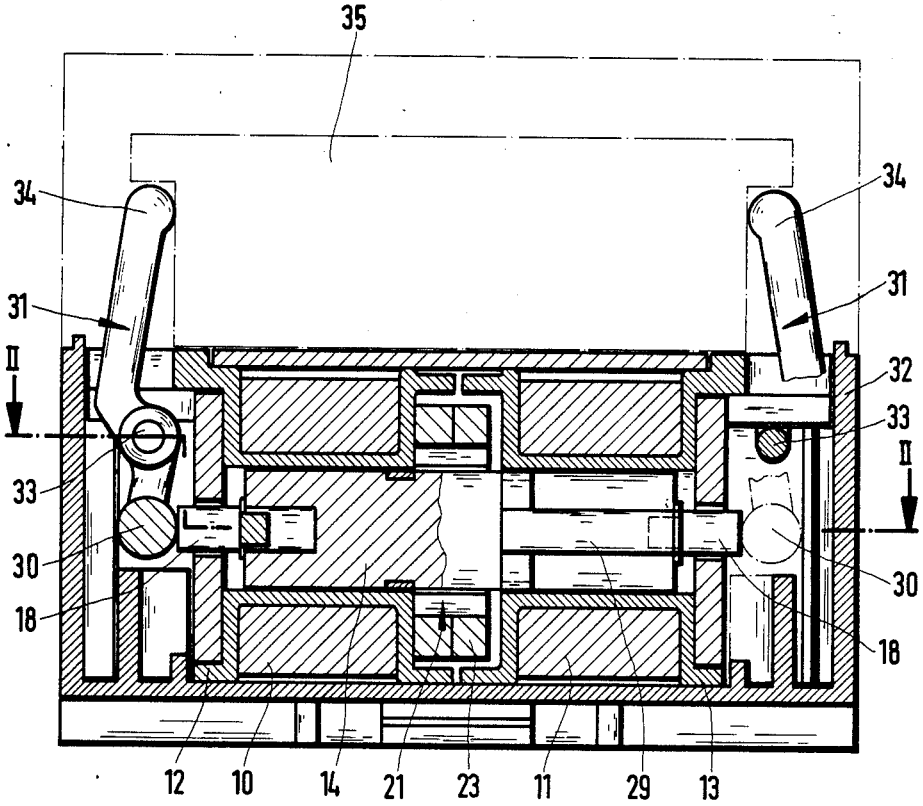
Figure 4:
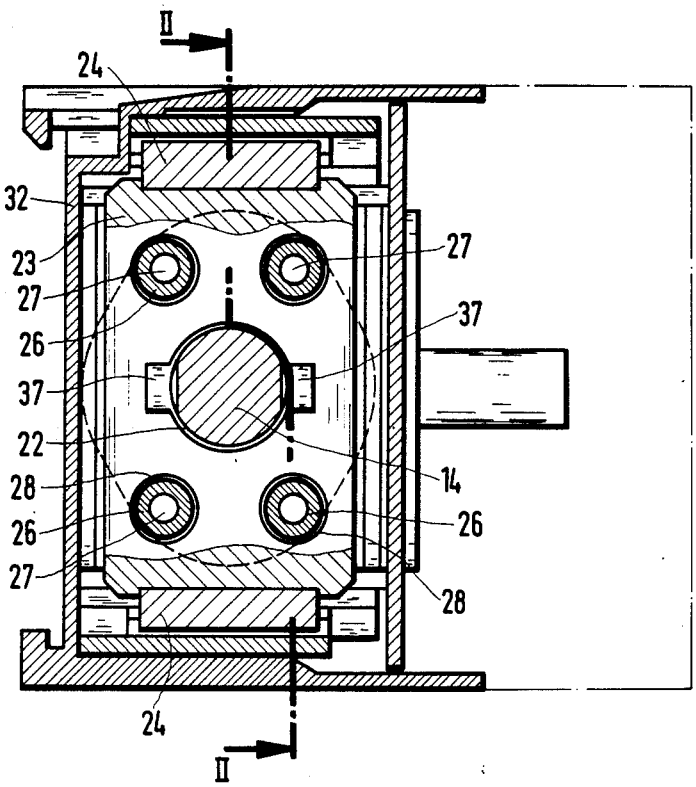
Figure 5:
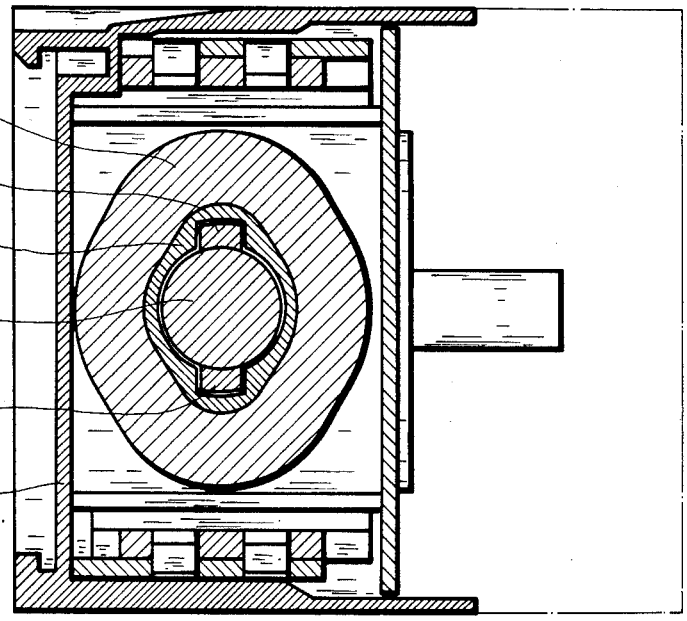
Figure 6:
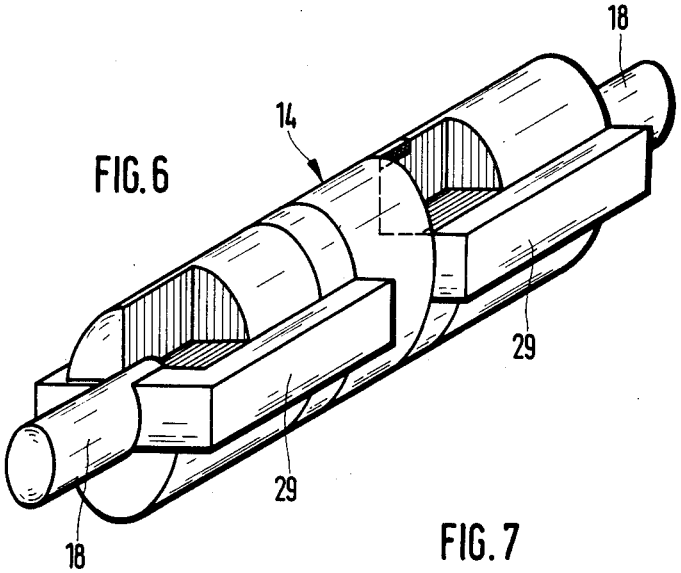

Preferred embodiments of the invention will now be described with referance to the drawings, in which FIG. 1 is a schematic longitudinal section through a magnetic drive according to a first embodiment which will be used to explain the principle of the invention, FIG. 2 is a more detailed longitudinal section, along the lines II—II of FIGS. 3 and 4 through a magnetic drive for an electromagnetic switching device according to a second embodiment of the invention, FIG. 3 is a longitudinal section along the line III—III in FIG. 2, FIGS. 4 and 5 are cross-sections along the lines IV—IV and V—V in FIG. 2, FIG. 6 is a perspective view, partly in section, of the armature used in the embodiment of FIGS. 2 to 5, and FIG. 7 is a longitudinal section, similar to FIG. 1, through a magnetic drive according to a third embodiment of the invention.

The magnetic drive shown in FIG. 1 includes two coils 10, 11 wound on respective bobbins 12, 13. The two bobbins 12, 13 are spaced along a common axis 9 and have a coaxial bore in which an armature 14 is movably supported. The armature 14 has two main portions 15,16 supported and guided in the respective bobbins 12, 13 and a middle portion 17 having a smaller diameter than the main portions 15, 16. A stud 18 is provided at each end face of the armature 14 for transmitting the armature movement to the contact system to be actuated (not shown in FIG. 1). Rectangularly bent yokes 19 and yoke plates 20 guide the magnetic flux at both ends and on the upper and lower sides of the coils 10, 11 as viewed in FIG. 1.

A control slider 21 is disposed in the space between the two coils 12, 13, with the middle portion 17 of the armature 14 extending through a central bore 22 of the slider. The slider 21 essentially consists of a soft-magnetic plate 23 in which two permanent magnets 24 are inserted. Guide members 25 of non-magnetic material are also inserted in the plate 23 on both end faces thereof in the area of the bore 22, which guide members not only serve for slidably bearing and guiding the slider 21 on the middle portion 17 of the armature 14 but also form stops for the inner annular surfaces of the armature main portions 15, 16.

FIG. 1 shows the control slider 21 in one of its end positions adjacent the left-hand bobbin 12. It is held in this position by the permanent-magnetic flux illustrated by dotted lines. The portion of the permanent-magnetic flux which penetrates the left-hand yokes 19 is stronger than the portion penetrating the right-hand yokes 19 because the right-hand flux portion, other than the left-hand portion, additionally has to overcome the air gaps between the outer surface of the soft-magnetic plate 23 and the yoke plates 20.

When the left-hand coil 10 is excited so that its flux has the same direction as the permanent-magnetic flux in the left-hand main portion 15 of the armature 14, the armature is moved to the left until the left-hand end face of the armature main portion 15 abuts the near-axis parts of the left-hand yokes 19. The force which drives the armature 14 can be increased by simultaneously exciting the right-hand coil 11 in such a way that its flux has the same direction as the flux of the left-hand coil 10 and is thus opposite to the permanent-magnetic flux in the right-hand main portion 16 of the armature 14. With this excitation, the control slider 21 is retained in the position shown in FIG. 1.

In a tri-stable embodiment of the switching device, the springs (identified by 36 in FIG. 2, but not shown in FIG. 1) which bias the armature 14 towards its mid-position are so dimensioned that their resetting force is smaller than the holding force generated by the magnets in either end position. On the other hand, in a switching device having a mono-stable mid-position of the armature, the resetting force excerted by the springs is greater than the permanent-magnetic holding force.

In the tri-stable version, if the coil is de-energized in the above-described condition, in which the armature 14 is in its left end position, the permanent-magnetic force will retain the armature 14 in this end position. To return the armature to the mid-position, the two coils 10, 11 are excited, over any desired period of time, in mutually opposite senses so that their fluxes oppose the permanent-magnetic fluxes. The magnetic force which has retained the armature 14 in its left end position, is thereby reduced to such an extent that the reset springs will now move the armature to its mid-position.

Due to the kinetic energy of the returning armature 14 and/or the fact that the breaking forces effective in the mid-position are reduced on account of an only pulse-wise excitation of the two coils 10, 11 in opposite senses, conventional switching devices without a control slider run the risk that the armature moves beyond its mid-position and may even reach the opposite end position where it is held by the permanent-magnetic force which will then be again effective upon de-energization. This risk is avoided by the control slider of the invention which, in the present case, is still in its left end position shown in FIG. 1 to form a stop for the left-hand armature main portion 15. Excitation of the two coils 10, 11 in mutually opposite senses causes no change in the position of the control slider 21, because the above-explained asymmetry of the air gaps with respect to the right and left magnetic flux portions is maintained.

When the armature 14 is to be moved to its right end position in FIG. 1, the right-hand coil 11 is excited so that its flux has the same direction as the permanent-magnetic flux in the right-hand armature main portion 16. The armature 14 and slider 21 are thus moved to the right. The force which effects this movement can be increased by exciting the left-hand coil 10 in the same sense. The slider 21 is now in its right end position according to FIG. 1 in which it is retained by the permanent-magnetic field even upon de-energization. The armature 14 is returned to its mid-position again by exciting the two coils 10,11 in mutually opposite senses, and movement of the armature beyond the mid-position is prevented by the slider 21 as above.

If the switching device is designed for a middle rest position, and assuming again the condition shown in FIG. 1, the armature 14 is moved from the mid-position to its left end position by exciting the coil 10 in such a manner that its flux has the same direction as the permanent-magnetic flux in the left-hand armature main portion 15. Again, the force which moves the armature 14 may be increased by exciting the coil 11 in the same sense as the coil 10 so that its flux is opposite to the permanent-magnetic flux in the right-hand armature main portion 16. In contrast to the tri-stable version, the armature 14 is returned simply by the action of all those springs (reset springs and contact springs) which effect a resetting when the excitation is switched off.

In a conventional switching device having no control slider, it is again possible for the armature to swing beyond the mid-position upon de-energization. While there is no risk in this case that the armature is retained in the other end position, undesired oscillations of the armature about the mid-position may occur. The control slider of the invention avoids such overshooting, thereby achieving an increased stabilisation of the monostable mid-position.

Changing-over the armature 14 and the slider 21 to the opposite end positions at the right in FIG. 1 is done in the same manner as described above for the tri-stable version.

As will be apparent from the above description, the control slider 21 is so dimensioned relative to the spacing between the two bobbins 12 and 13 and relative to the axial length of the armature middle portion 17 that it permits the armature 14 to move to its respective end position and stops an opposite movement of the armature at the mid-position. In the embodiment of FIG. 1, where the axial length of the armature middle portion 17 is equal to the spacing between the two bobbins 12 and 13, the above function requires the difference between this dimension and the axial length of the slider 21 to be identical to, or greater than, the travel of the armature 14 from its mid-position to either end position.

The embodiment of FIGS. 2 to 5 does not basically differ from that of FIG. 1. Only the permanent magnets 24 are not inserted in the soft-magnetic plate 23 of the slider 21 but are disposed adjacent the yoke plates 20 at the upper and lower edges of the plate 23, as shown in FIGS. 2 and 4. In this case, the magnets 24 are preferably magnetized, not in the radial direction of the slider 21 as shown in FIG. 1, but in such a manner that the surface facing the plate 23 forms one pole and the opposite surface as well as the outer areas of both end faces form the other pole to achieve good magnetic coupling between the magnets 24 and the adjacent end faces of the yokes 19.

Further reference to the embodiment of FIGS. 2 to 6 is made to explain a practical structure of a magnetic drive for an electromagnetic switching device, particularly details relating to the design of the bearing of the armature 14 and slider 21.

As will be apparent especially from FIGS. 2 and 4, the two bobbins 12, 13 are interconnected by plug connectors wherein each bobbin 12, 13 has two sockets 26 and two studs 27 formed on the end face opposite the respective other bobbin for engagement with the studs and sockets of the latter. The cylindrical outer surfaces of the sockets 26 extend through four corresponding bores 28 in the rectangular soft-magnetic plate 23, thereby serving for slidably bearing and guiding the slider 21. In contrast to FIG. 1, the slider 21 of the embodiment of FIGS. 2 to 6 is thus supported by the bobbin assembly 12, 13 rather than by the armature 14.

According to FIG. 6, the armature 14 is a circular-cylindrical member formed of soft-magnetic material. It has webs 29 of rectangular cross-section which project from the periphery at diametrically opposite locations. The webs 29 are interrupted at the middle portion of the armature 14 to provide a spacing which corresponds to the axial length of the middle portion 17 of the armature 14 of FIG. 1. The two end faces of the webs 29 which face each other form the stops for the slider 21.

Each pair of diametrically opposite webs 29 is integrally formed with the stud 18 projecting from the respective end face of the armature 14 in the form of a plastics embedding of the armature 14. Each embedding is formed as a one-piece molding and is reinforced and, at the same time, fixed to the armature by engagement with an end bore provided in the armature, with an annular groove formed in the area of the ends of the webs 29 which form the stops, and with two diametrically opposite grooves extending in the axial direction of the peripheral surface of the armature 14.

As will be apparent from FIGS. 2 and 3, the outer ends of the studs 18 bear against the lower ends 30 of two-armed levers 31 each of which is mounted for pivotal movement about an axial pin 33 inserted in the housing 32 of the switching device. The upper ends 34 of the levers 31 actuate a contact slider of a contact system 35 which is shown only in phantom lines in FIG. 3. As usual, movable contacts are mounted on such contact slider, each movable contact cooperating with a pair of fixed contacts to form a change-over contact. According to FIG. 2, two leaf springs 36 are inserted in recesses of the housing 32, an inwardly bent middle portion of each leaf spring 36 bearing against the outer side of the lower end 30 of the respective lever 31. The two leaf springs 36 are biassed against each other so as to urge the armature 14 towards its mid-position shown in FIGS. 2 and 3.

For mounting the magnetic drive according to the embodiment of FIGS. 2 to 6, the slider 21, which consists of the soft-magnetic plate 23 with the magnets 24, is first slid with its central bore 22 onto the armature 14 provided with the plastics embeddings 18, 29. For this purpose, the bore 22 is provided with two diametrically opposite rectangular cut-outs 37 shown in FIGS. 4 and 5 to permit the webs 29 to pass. Subsequently, the armature 14 and slider 21 are rotated 90° with respect to each other so that the webs 29 then form stops for the slider 21. In the completed condition, rotation of the armature 14 is prevented by engagement of the webs 29 in recesses 38 provided in the bobbins 12, 13 as shown in FIG. 5, and rotation of the control slider 21 is prevented by the sockets 26. Thus, the webs 29 serve not only as stops for the slider 21 but also for bearing and guiding the armature 14 in the bobbins 12, 13. Since the webs 29 are made of non-magnetic material, magnetic "sticking" to the slider 21 is prevented.

Figure 7:
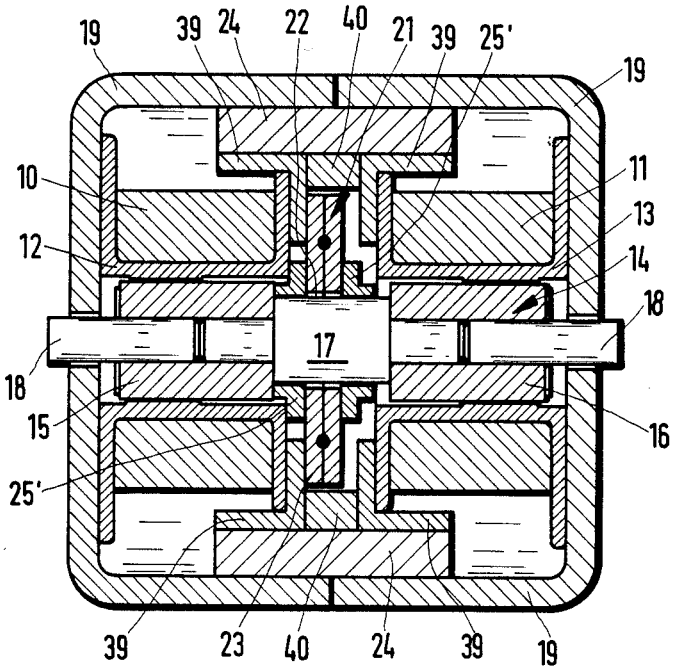

The embodiment shown in FIG. 7 differs from those of FIG. 1 and FIGS. 2 to 6 in that the permanent magnets 24 are connected not to the movable slider 21 but to the stationary yokes 19, and that the slider 21 consists essentially only of the soft-magnetic plate 23. The version of FIG. 7 provides the advantage that a substantially larger volume is available for the magnets 24 at a given axial length of the switching device. In this case, the magnets may be made of a comparatively inexpensive magnet material such as bariumferrite, whereas highly coercive materials such as samariumcobalt mixtures are preferred in the previous embodiments.

Similar to FIG. 1, non-magnetic guide rings 25' are disposed on both end faces of the plate 23 to serve not only for slidingly guiding and bearing the control slider 21 on the middle portion 17 of the armature 14 but also as stops against the armature main portions 15 and 16. The magnetic flux from the magnets 24 is transmitted to the control slider 21 via rectangularly bent pole shoes 39 provided on the interior side of the magnets 24 and abutting the inner end faces of the bobbins 12, 13, and via pole pieces 40 inserted between the pole shoes 39. The arms of the pole shoes 39 extending perpendicularly to the axis of the armature 14 reduce the spacing available for the movement of the slider 21 between the bobbins 12 and 13. For this reason, the soft magnetic plate 23 is formed as a comparatively thin disk. In order to ensure proper sliding of the disk, in spite of its small thickness, on the middle portion 17 of the armature 14, the guide rings 25' extending from the outer side of the plate 23 are formed with axial increased thicknesses within the bore of the bobbins 12, 13.

FIG. 6, just as FIG. 1, shows only the magnetic drive of a contactor; the armature movement may be transmitted to a contact system as explained in the embodiment of FIGS. 2 to 6.

I claim:

1. A polarized magnetic drive for an electromagnetic switching device comprising two coils arranged along a common axis, a permanent magnet assembly which is substantially symmetrical to the center plane between the two coils, an armature actuated by the magnetic fluxes of the coils and the magnet assembly and being movable relative to the coils to a first end position upon excitation of the coils for producing a coil flux of one polarity, and to a second end position upon excitation of the coils for producing a coil flux of the opposite polarity, and a control slider also actuated by the magnetic fluxes of the coils and the magnet assembly and being movable, upon excitation of the coils, along the coil axis between the two coils, the slider forming stops for stopping the armature in a mid-position in either direction of armature movement.

2. The magnetic drive of claim 1, wherein the magnet assembly is connected to the control slider.

3. The magnetic drive of claim 2, wherein the magnet assembly includes two permanent magnets included in a soft-magnetic plate.

4. The magnetic drive of claim 1, wherein the magnet assembly is stationary with respect to the coils.

5. The magnetic drive of claim 1, wherein the armature includes a pair of main portions and a middle portion having a smaller cross section than the main portions and extending through an aperture in the control slider.

6. The magnetic drive of claim 1, wherein nonmagnetic material is provided in the area of the stops for the armature.

7. The magnetic drive of claim 6, wherein the nonmagnetic material is disposed at end faces of the control slider.

8. The magnetic drive of claim 7, wherein the control slider includes a bearing member of non-magnetic material slidable on the middle portion of the armature.

9. The magnetic drive of claim 6, wherein the stops for the armature are formed by webs of non-magnetic material projecting laterally from the armature.

10. The magnetic drive of claim 9, wherein the webs form guide members for the armature within a bobbin assembly carrying the coils.

11. The magnetic drive of claim 9, wherein the armature includes a plastics embedding forming the webs and end studs for transmitting the armature movement.

12. The magnetic drive of claim 1, wherein the control slider is disc-shaped and slidably supported on connecting elements of a two part bobbin assembly carrying the coils.

13. The magnetic drive of claim 1, wherein the magnet assembly is disposed between the two coils symmetrically to both the coil axis and to the coils.

14. The magnetic drive of claim 1, wherein the magnet assembly is disposed in a central region defined between the two coils symmetrically to both the coil axis and to the coils.

* * * * *